US005482069A

United States Patent [19]

Lee

[11] Patent Number: 5,482,069

[45] Date of Patent: Jan. 9, 1996

[54] SUNSHADE

[76] Inventor: Chorng-Cheng Lee, No. 6, Lane 224, Wu Feng South Road, Chia Yi City, Taiwan

[21] Appl. No.: 442,345

[22] Filed: May 16, 1995

[51] Int. Cl.[6] ..... A45B 25/00

[52] U.S. Cl. ..... 135/31; 135/33.7

[58] Field of Search ..... 135/20.1, 31, 33.2, 135/33.4, 33.41, 33.7

[56] References Cited

U.S. PATENT DOCUMENTS

| | | | |
|---|---|---|---|
| 212,457 | 2/1879 | Girbardt | 135/33.7 |
| 1,082,645 | 12/1913 | Myers | 135/33.41 |
| 2,531,735 | 11/1950 | Jones | 135/33.41 |
| 5,078,166 | 1/1992 | Lee | 135/33.7 |
| 5,115,827 | 5/1992 | Lee | 135/33.7 |
| 5,368,055 | 11/1994 | Johnson et al. | 135/33.4 X |

FOREIGN PATENT DOCUMENTS

| | | | |
|---|---|---|---|
| 0692497 | 11/1930 | France | 135/33.7 |
| 0008229 | of 1885 | United Kingdom | 135/33.7 |

*Primary Examiner*—Lanna Mai

*Attorney, Agent, or Firm*—Morton J. Rosenberg; David I. Klein

[57] ABSTRACT

A sunshade includes a solid shaft, a support rib set, a stretching rib set. The two rib sets are respectively associated with a runner fitted movably around the solid shaft to stretch open or fold close the two rib sets radially disposed. Each support rib of the support rib set being pivotally and crossingly connected with each related stretching rib of the stretching rib set at an end portion of the stretching rib and at an intermediate portion of the support rib. A lower shading canvas is disposed to cover a lower annular portion of the support rib set. An upper canvas is disposed to cover an upper portion of the support rib. An aperture is formed between the upper canvas and the lower canvas after the two rib sets are stretched open to allow strong wind blowing in the interior of the two canvases to escape through the aperture.

2 Claims, 7 Drawing Sheets

SUNSHADE

BACKGROUND OF THE INVENTION

This invention concerns a sunshade, particularly one having two layers of shading canvases with an aperture formed between the two layers of canvases for strong wind to escape from the interior of the canvases to the exterior thereof so as to prevent the sunshade from blown down or swaying vehemently.

Sunshades are widely used in a leisure plaza, outdoor coffee seats, in a private villa, etc. for shading bright sunshine from people enjoying resting activities. Known conventional sunshades shown in FIGS. 5 and 6 includes a solid shaft 10, stretching ribs 20 associated in radial directions with a runner movably fitted around the shaft 10, support ribs 30 respectively connected at a proper position to the stretching ribs 20 and pivotally fixed to a top cap so as to expand in radial direction. And a shading canvas 40 is attached on the support ribs 30. Then, the solid shaft 10 is fitted in a vertical cylindrical rod of a position base 50, kept standing on the ground.

However, most sunshades are sized large, liable to be blown to sway hard, and if worse, possible to be blown to fall down on the ground because of the canvas receiving strong wind force with no means for wind blowing in to escape out of the interior of the canvas to the exterior.

SUMMARY OF THE INVENTION

This invention has been devised to offer a kind of sunshade having two layers of shading canvases and an aperture formed between the two layers of canvases so that the whole sunshade may be avoided from blown down by strong wind, which can escape from the interior of the canvases to the exterior thereof through the aperture.

BRIEF DESCRIPTION OF DRAWINGS

The invention will be better understood by reference to the accompanying drawings, wherein.

DESCRIPTION OF THE PREFERRED EMBODIMENTS

Figure 1:
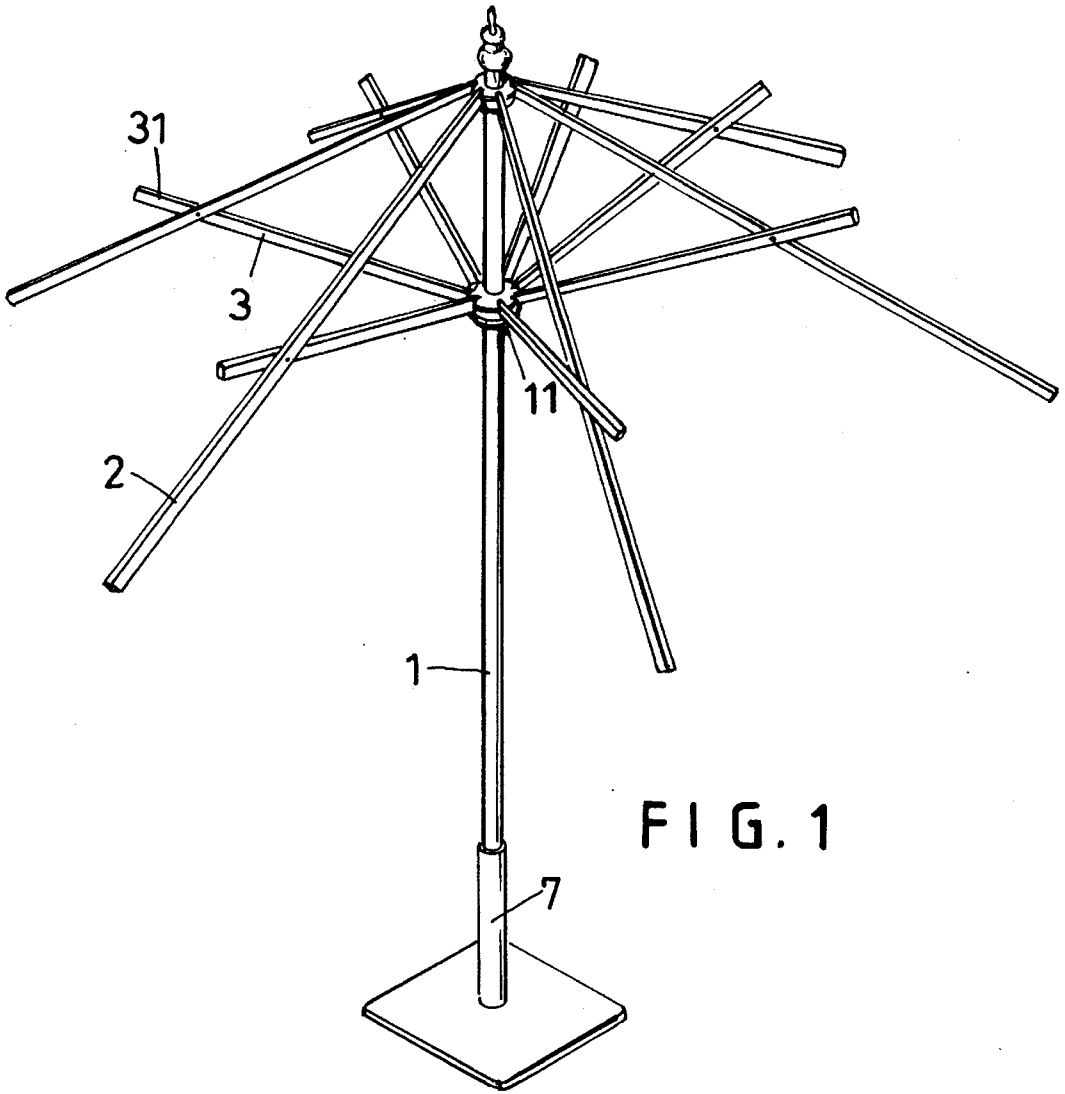
FIG. 1 is a perspective view of a sunshade in the present invention, showing its skeleton.
Figure 2:
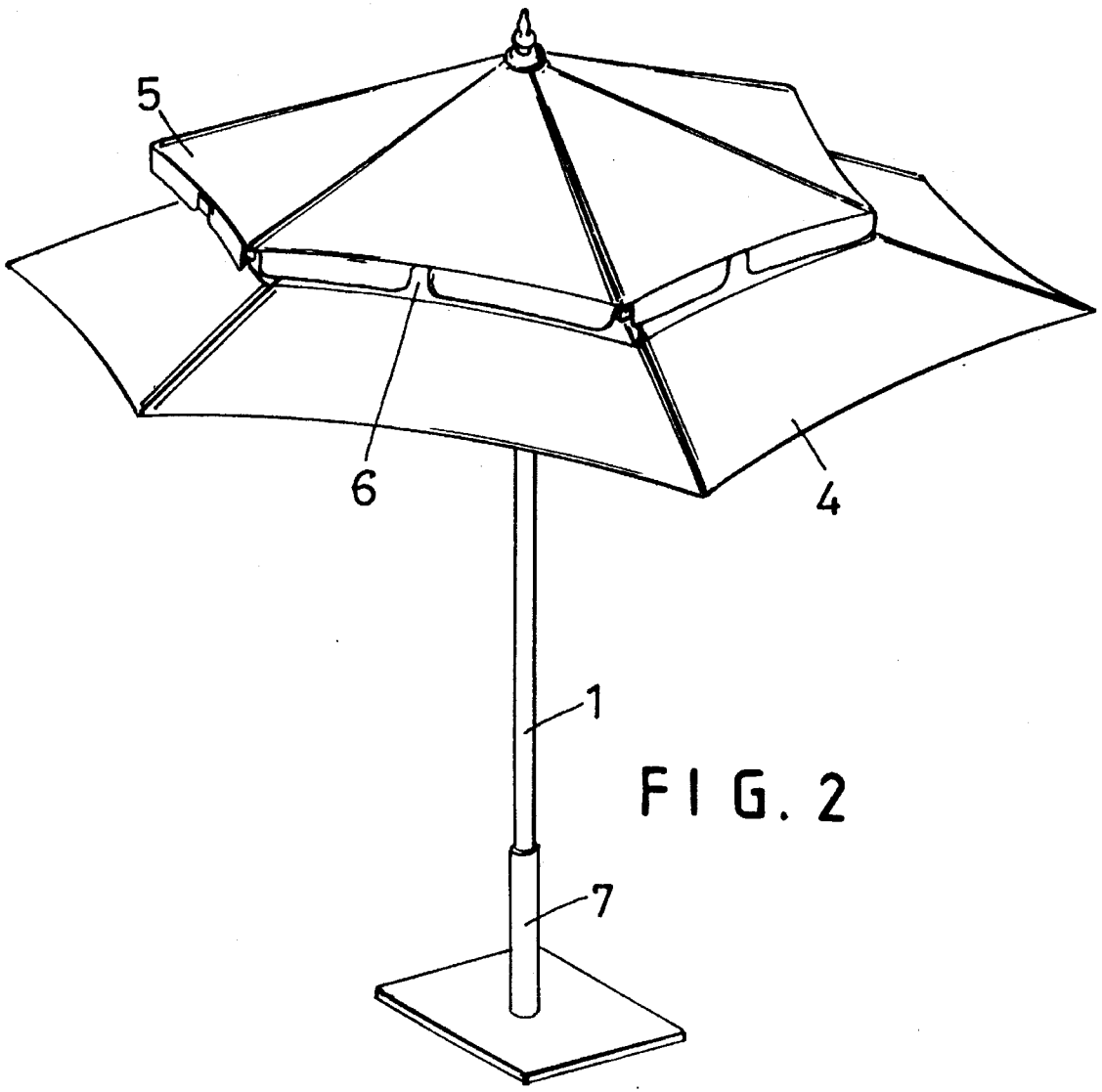
FIG. 2 is a perspective view of the sunshade in the present invention, showing it being opened.
Figure 3:
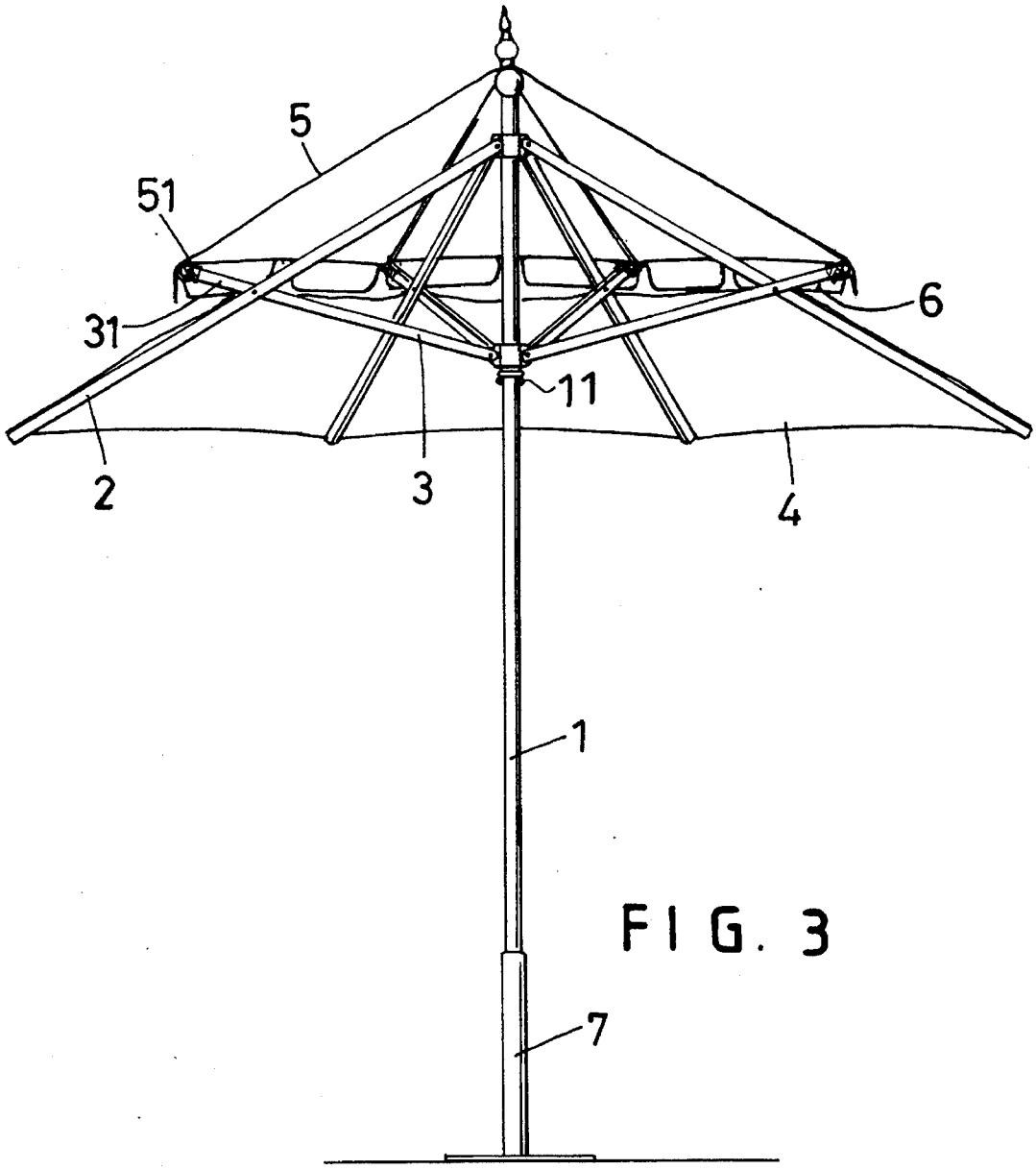
FIG. 3 is a side view of the sunshade in the present invention showing it being stretched open.
Figure 4:
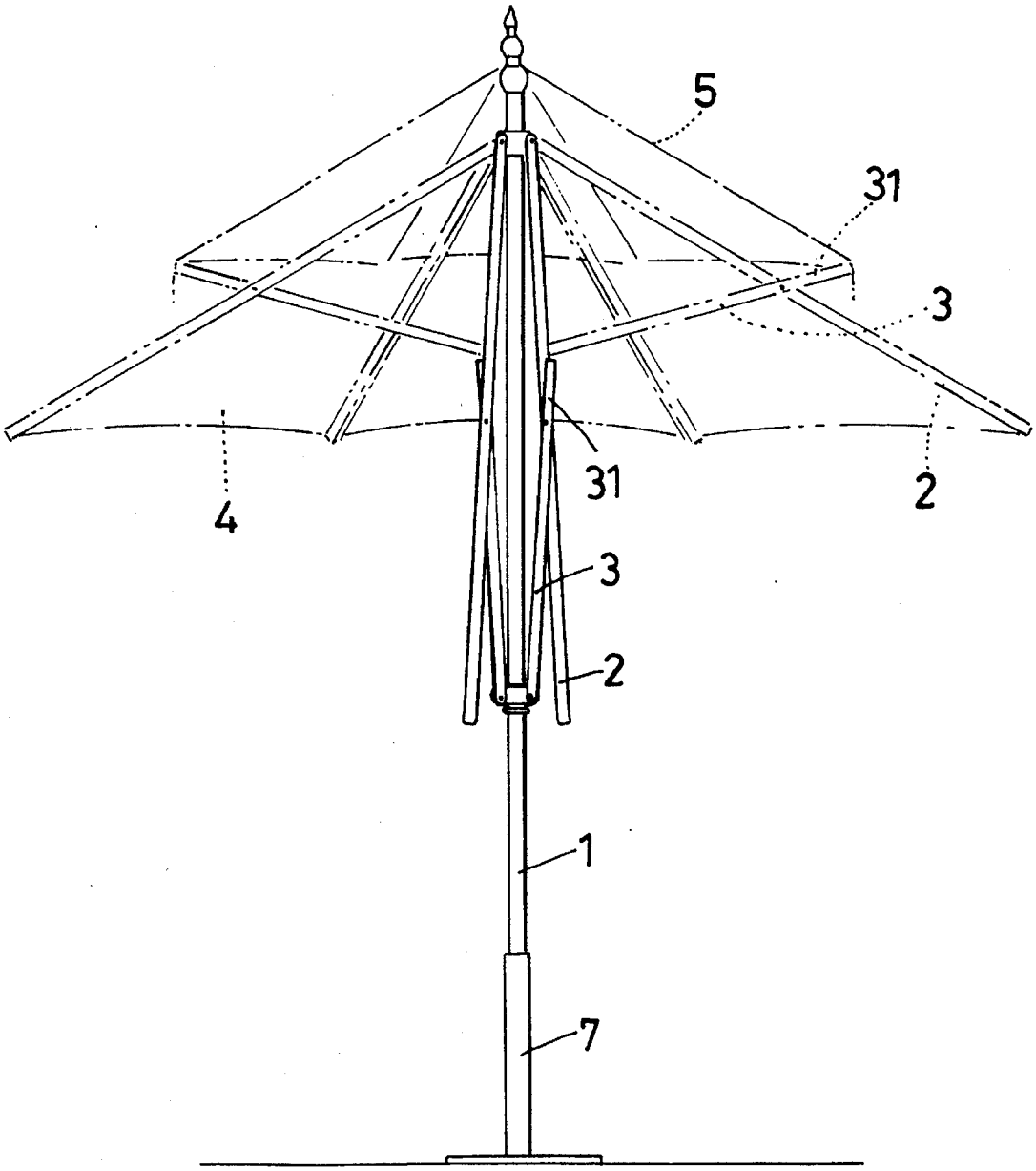
FIG. 4 is a side view of the sunshade in the present invention, showing is being folded up.
Figure 5:
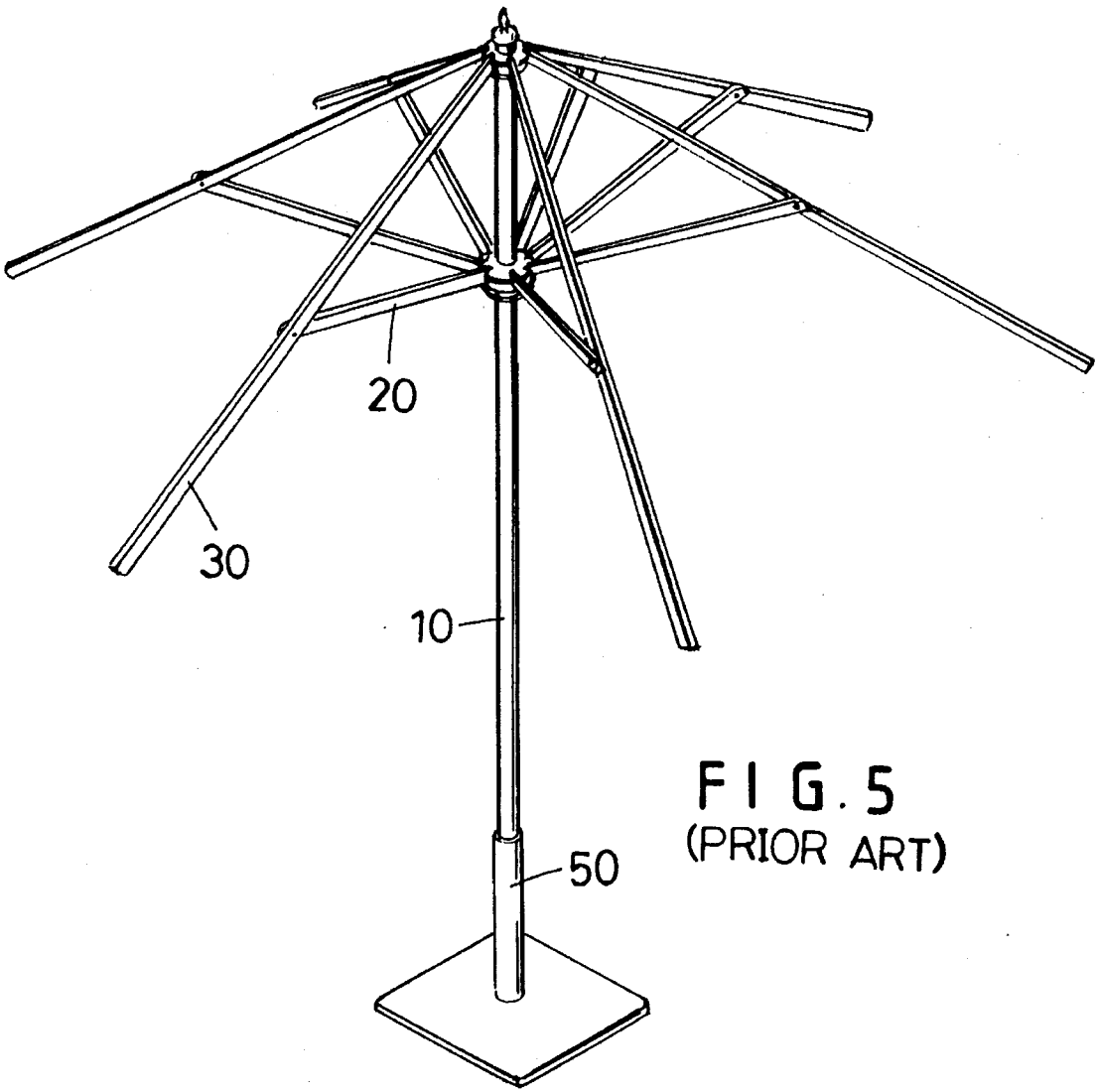
FIG. 5 (PRIOR ART)
FIG. 5 is a perspective view of a conventional sunshade, showing its skeleton.
Figure 6:
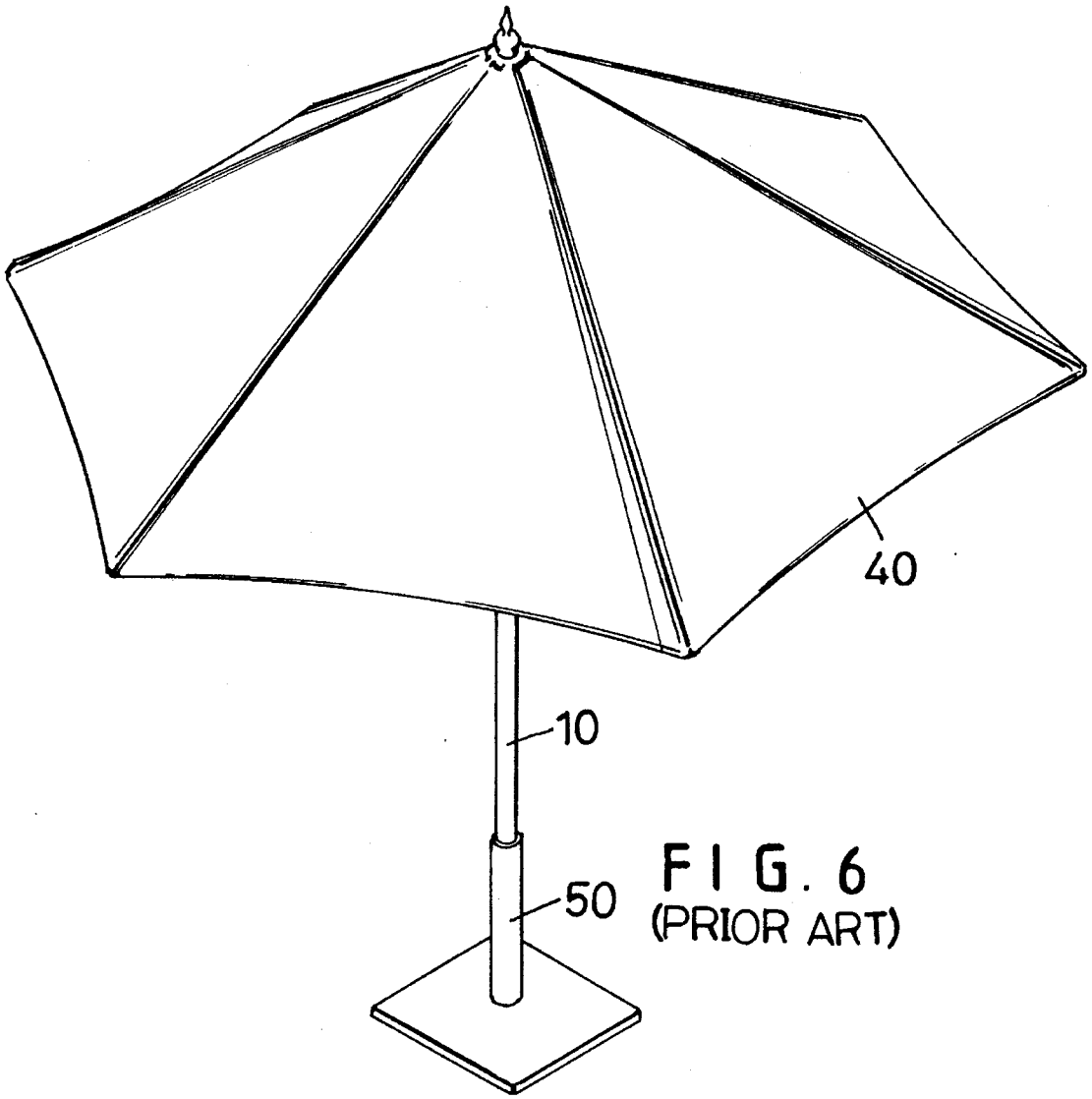
FIG. 6 (PRIOR ART)
FIG. 6 is a perspective view of the conventional sunshade shown in FIG. 5.
Figure 7:
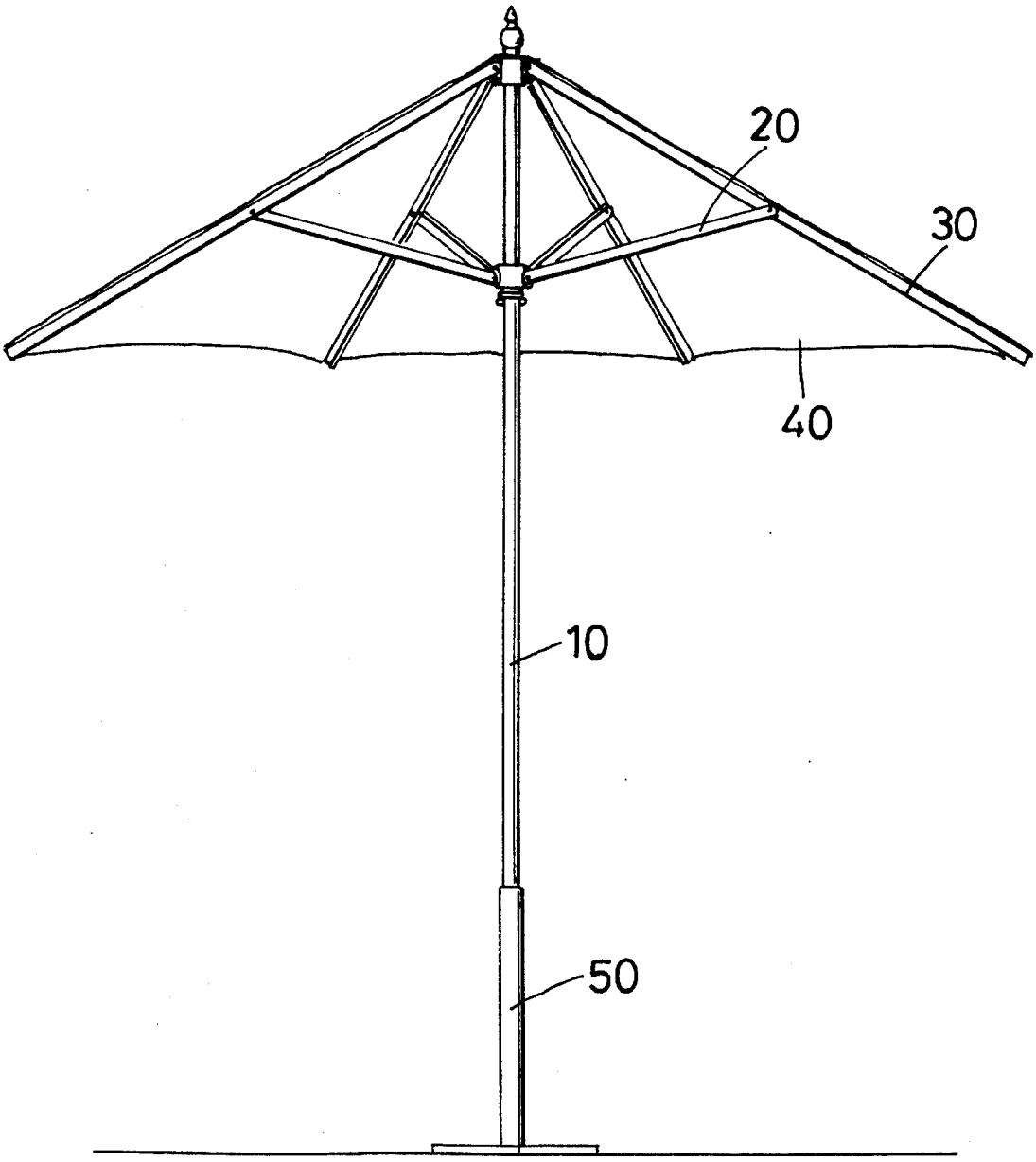
FIG. 7 (PRIOR ART)
FIG. 7 a sectional view of the conventional sunshade skeleton shown in FIG. 5.

A sunshade in the present invention, as shown in FIGS. 1 and 2, includes solid shaft 1, a support rib set 2, a stretching rib set 3, a lower canvas 4 and an upper canvas 5, and two runners provided to fit movably around the solid shaft 1 and associated respectively with the support rib set 2 and the stretching rib set 3 so that the two rib sets 2 and 3 can be folded down or stretched open upward by means of pivotal connections. The two runners have a conventional structure of a well-known art, so their detailed description is not necessary.

Each support rib of the support rib set 2 and each stretching rib of the stretching rib set 3 are pivotally and crossingly connected at an end portion 31 of each stretching rib of the stretching rib set 3 and at an intermediate portion of each support rib of the support rib set 2.

The lower canvas 4 is disposed to cover the lower annular portion of the support rib set 2, having its lower circumferential ends secured at the lower ends of all support ribs of the support rib set 2 and its upper circumferential end secured at the pivotally connected point of each support rib of the support rib set 2 and the related stretching rib of the stretching rib set 3. The upper canvas 5 is disposed to cover the upper portion of the support rib set 2, having its top secured around a top cap and its lower end 51, secured around the end portion 31 of each rib of the stretching rib set extending outward from the pivotal connecting point of each support rib of the support rib set 2 and each stretching rib of the stretching rib set 3.

The lower canvas 4 and the upper canvas 5 are located in such a manner that an aperture 6 is formed between them after they are stretched open so that even if strong wind blows into this sunshade, the aperture 6 can allow wind to blow up to escape therethrough, preventing the whole sunshade from blown down.

In case that the stretched open canvases 4 and 5 are to be folded close, two protrusion heads 11 at two opposite sides of the solid shaft 1 are pushed manually inward to let a runner to slide down along the solid shaft 1 so that the support rib set 2 and the stretching rib set 3 can accordingly be folded close inward, collapsing the whole sunshade. The structure related to the protrusion head 11 is a known conventional art, not described here.

A cylindrical support let 7 with a round heavy plate resting on the ground is provided to support the solid shaft 1 to stand on the ground.

The sunshade having two layers of canvases in the present invention is considered to have the following advantages:

1. It can be prevented from swaying hard or falling down owing to strong wind, which can blow in its interior and then escape out of the aperture between the upper and the lower canvases.

2. It has two layers of shading canvases, the upper and the lower layers, to show a special beautiful appearance.

While the preferred embodiments of the invention have been described above, it will be recognized and understood that various modifications may be made therein and the appended claims are intended to cover all such modifications which may fall within the spirit and scope of the invention.

What is claimed is:

1. A sunshade comprising a support rib set and a stretching rib set disposed in radial direction and associated with runners fitted movedly around a solid shaft, each support rib of said support rib set being pivotally and crossingly connected with each stretching rib of said stretching rib set at an end portion of each said stretching rib and at an intermediate portion of each said support rib, an upper shading canvas being located to cover an upper half portion of said support rib set with its lower end secured around said end portion of each said stretching rib, a lower shading canvas being located to cover a lower annular portion of said support rib set, and an aperture being formed between said upper canvas and said lower canvas for air to flow through said aperture from the interior of said sunshade to the exterior thereof so that said whole sunshade may not sway hard or fall down owing to strong wind.

2. The sunshade as claimed in claim 1, wherein said upper shading canvas has a cylindrical end for an end of each said stretching rib of said stretching rib set to fit therein, thereby secured in its position.

* * * * *